US010041312B2

(12) United States Patent
Lindberg

(10) Patent No.: US 10,041,312 B2
(45) Date of Patent: Aug. 7, 2018

(54) DEVICE FOR HANDLING DRILL STRING COMPONENTS OF A DRILL STRING, METHOD FOR HANDLING DRILL STRING COMPONENTS AND ROCK DRILLING RIG

(71) Applicant: EPIROC ROCK DRILLS AKTIEBOLAG, Orebro (SE)

(72) Inventor: Johan Lindberg, Saltsjö-boo (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 348 days.

(21) Appl. No.: 14/651,459

(22) PCT Filed: Nov. 22, 2013

(86) PCT No.: PCT/SE2013/051375

§ 371 (c)(1),
(2) Date: Jun. 11, 2015

(87) PCT Pub. No.: WO2017/098708

PCT Pub. Date: Jun. 26, 2014

(65) Prior Publication Data

US 2015/0315857 A1 Nov. 5, 2015

(30) Foreign Application Priority Data

Dec. 21, 2012 (SE) ..... 1251482

(51) Int. Cl.
*E21B 19/15* (2006.01)
*E21B 19/20* (2006.01)
(Continued)

(52) U.S. Cl.
CPC ..... *E21B 19/155* (2013.01); *E21B 17/00* (2013.01); *E21B 19/14* (2013.01); *E21B 19/15* (2013.01); *E21B 19/20* (2013.01); *E21B 19/24* (2013.01)

(58) Field of Classification Search
CPC ..... E21B 19/155; E21B 19/20; E21B 19/24; E21B 19/14; E21B 19/15; E21B 17/00
(Continued)

(56) References Cited

U.S. PATENT DOCUMENTS 4,718,805 A * 1/1988 Becker ..... E21B 19/155 175/85
5,669,653 A 9/1997 Penisson
(Continued)

FOREIGN PATENT DOCUMENTS

AU 693382 B2 6/1998
AU 2005287828 A2 3/2006
(Continued)

OTHER PUBLICATIONS

PCT/ISA/210—International Search Report—dated Mar. 28, 2014 (Issued in Application No. PCT/SE2013/051375).
PCT/ISA/237—Written Opinion of the International Searching Authority—dated Mar. 28, 2014 (Issued in Application No. PCT/SE2013/051375).

*Primary Examiner* — George S Gray
(74) *Attorney, Agent, or Firm* — Venable LLP; Jeffri A. Kaminski

(57) ABSTRACT

Handling device for a rock drill rig for handling drill string components for a drill string, wherein the handling device includes a linear guide, a slide being displaceable along the linear guide, and, supported by the slide, a gripping device, being displaceable between a drill string position in the rock drill rig and a delivering position outside the rock drill rig. The gripping device is supported by a swing arm which is swing drivable around a first rotational axis. The swing arm is swing drivable in respect of the slide around a second rotation axis. The swing arm support and the swing arm are swing drivable around a third rotational axis for swinging the gripping device to the drill string position.

23 Claims, 5 Drawing Sheets

(51) Int. Cl.
*E21B 17/00* (2006.01)
*E21B 19/24* (2006.01)
*E21B 19/14* (2006.01)

(58) Field of Classification Search
USPC ..... 175/52
See application file for complete search history.

(56) References Cited

U.S. PATENT DOCUMENTS

| | | | | |
|---|---|---|---|---|
| 5,941,324 | A * | 8/1999 | Bennett | E21B 19/14 166/77.51 |
| 6,270,136 | B1 | 8/2001 | Dagenais | |
| 6,634,443 | B1 * | 10/2003 | Paech | E21B 15/04 17/85 |
| 2009/0238663 | A1 * | 9/2009 | Littlely | E21B 19/155 414/22.54 |
| 2011/0148133 | A1 | 6/2011 | Hessels et al. | |
| 2012/0097454 | A1 * | 4/2012 | Kockeis | E21B 19/15 175/57 |

FOREIGN PATENT DOCUMENTS

| | | | | |
|---|---|---|---|---|
| SU | 582175 | | 11/1977 | |
| WO | WO-00/65193 | A1 | 11/2000 | |
| WO | WO-2005073497 | A1 * | 8/2005 | E21B 19/155 |
| WO | WO-2011120627 | A2 * | 4/2010 | E21B 19/155 |

* cited by examiner

DEVICE FOR HANDLING DRILL STRING COMPONENTS OF A DRILL STRING, METHOD FOR HANDLING DRILL STRING COMPONENTS AND ROCK DRILLING RIG

CROSS-REFERENCE TO RELATED APPLICATIONS

The application claims priority to Swedish patent application 1251482-4 filed 21 Dec. 2012 is the national phase under 35 U.S.C. § 371 of PCT/SE2013/051463 filed 22 Nov. 2013.

FIELD OF THE INVENTION

The present invention relates to a handling device for a rock drill rig for handling drill string components for a drill string, wherein a gripping device for gripping a drill string component is displaceable between a drill string position in the rock drill rig and a delivering position outside the rock drill rig. The invention also relates to a method and a rock drill rig.

BACKGROUND OF THE INVENTION

During drilling of long bore holes for e.g. exploration drilling, considerable time is consumed for handling drill string components during drilling, when the drill string is subsequently lengthened, as well as for replacement of drill bit which has to be performed regularly because of ongoing wear of drill bits during drilling.

Different suggestions have been made to facilitate this handling, one of which being a handling device for a rock drill rig being previously known from AU-B-64377/96, wherein drill string components are brought into a supporting device in the form of a one way sleeve for the transfer of the drill string component between a horizontal and a vertical position. This known device does not provide stable handling of the drill string components.

FIELD AND MOST IMPORTANT FEATURES OF THE INVENTION

One aim of the present invention is to provide a device as mentioned initially which allows flexible and still secure handling of drill string components.

This aim is obtained in respect of a handling device according to the above when the handling device includes a linear guide to be arranged in connection with and in parallel with the feed beam, and a slide being displaceable along the linear guide, that the gripping device is supported by a swing arm which in turn is supported by the slide, that the swing arm with supported gripping device is swing drivable in respect of a swing arm support being connected to the slide with the aid of a first rotator around a first rotational axis being parallel to and at a distance from an axis of a drill string component being gripped by the gripping device, that the swing arm support and thereby the swing arm with supported gripping device is swing drivable in respect of the slide with the aid of a second rotator around a second rotation axis forming an angle with the linear guide as well as with the first rotational axis, and that the swing arm support and thereby the swing arm with supported gripping device is swing drivable around a third rotational axis parallel to the linear guide with the aid of a third rotator for swinging the gripping device to the drill string position.

Hereby a flexible handling device is provided which is capable of performing accurate transfers of drill string components, on the one hand into the drill string position because of the combination of the construction of the gripping device with axially separated gripper pairs and the extensive control possibilities being offered through the three specially positioned rotators. By swinging the swing arm around the first rotational axis, the gripping device can be turned for example in against and out from the drill string position. It also results in that the gripping device can be fine adjusted in order to grip a drill string having a position somewhat deviating from an exact delivering position. A turning radius for swinging of a drill string component is also adjustable, for example to different sized feed beams being applied according to the invention.

The combination of the ability to swing and the slide being displaceable along the linear guide allows that the delivering position is easily varied in vertical direction for the freedom of positioning magazines of different sizes and heights, and such that even magazine having a plurality of horizontal levels can be used in connection with the invention.

With "delivering position" is here intended a position of a drill string component to be gripped by the gripping device (pick-up position), as well as a position for a drill string component to be released by the gripping device (release position). This can normally be a defined position in a magazine but it can also be another specified position of a drill string component intended to be gripped or released.

The linear guide is preferably a separate unit being attachable to the feed beam. Hereby it can be arranged for a standard rig without requirements to amend the feed beam etc. It can also be applied in an existing rig without major modifications thereto. It should, however, be noted that it is possible within the scope of the invention to construct the linear guide as a unit together with the feed beam.

The third rotational axis is preferably positioned between the linear guide and fastening points therefore on the feed beam, wherein the ability to swing around the third rotation axis, being parallel to the linear guide, also includes swing driving the linear guide. This gives possibility of having a great movement range of the handling device and allows higher degree of rigidity of components supporting the slide compared to if the third rotational axis would be positioned between the slide and the gripping device.

It is particularly preferred that the gripping device is supported axially displaceably drivable along a swing arm, as seen in an axial direction of a gripped drill string component. This gives advantages in respect of positioning the gripping device in axial direction in respect of a drill string component to be gripped. Not least in combination with the displaceability along the linear guide. Further, the displaceability along the swing arm allows increased possibilities of adjusting a delivering position for drilling operations in different inclinations of the feed beam and thereby the linear guide. This displaceablity along the swing arm is suitably realised with the aid of a hydraulic cylinder.

A support for the second rotator is suitably rigidly connected to the slide. It is further preferred that a first exit axis, protruding from the first rotator, is rigidly connected to the swing arm, and that a second exit axis protruding from the second rotator is rigidly connected to a main portion of the first rotator. This allows a stable and compact construction.

It is preferred that the second rotational axis forms essentially a right angle to the linear guide as well as to the first rotational axis.

The linear guide preferably includes a linear driving device for the slide in the form of chain drive or a hydraulic cylinder.

The handling device preferably also includes a magazine having support members for supporting drill string components. These units can be tuned to each other in an advantageous way for achieving co-adjustment of the movement pattern thereof. The magazine is suitably displaceably connected to the rock drill rig, which is advantageous for adapting to i.a. an existing inclination of the feed beam. In particular the magazine is displaceable in directions in parallel to axial directions of drill string components being received in the magazine.

The magazine preferably includes support members in the form of component brackets in a plurality of levels, wherein the component brackets on one level are removable for allowing access to drill string components on a lower level.

Said support members are suitably arranged for receiving a plurality or drill string components on the same level, wherein said support members are adjustable to incline towards the delivering position when it is a pick-up position for the gripping device, and from the delivering position when it is a release position for the gripping device.

The gripping device has preferably a considerable axial extension in relation to the length of a drill string component and preferably includes at least two axially separated gripper pairs in order to achieve stable gripping of a drill string component for minimal tendency to wobble.

The invention also relates to a method for handling drill string components of a drill string of a rock drill rig, wherein the method includes: displacing a slide along a linear guide to be arranged in parallel with the feed beam, gripping a drill string component with a gripping device being supported by the slide, and displacing the gripping device between a drill string position in the rock drill rig and a delivering position outside the rock drill rig. The method also includes: swinging a swing arm supporting the gripping device in respect of a swing arm support being connected to the slide around a first rotational axis, being parallel to and at a distance from an axis of a drill string component being gripped by the gripping device, swinging the swing arm support and thereby the swing arm with supported gripping device, in respect of the slide, around a second rotation axis, forming an angle with the linear guide as well as with the first rotational axis, and swinging the swing arm support, and thereby the swing arm with supported gripping device around a third rotational axis parallel to the linear guide, for swinging the gripping device to the drill string position.

Through this method, advantages are achieved corresponding to what is related to the inventive device.

Features corresponding to subordinate device features according to the above are applicable in connection with the inventive method and result in corresponding advantages.

The invention also relates to a rock drill rig having a rotator being displaceable along a feed beam, and including an inventive handling device.

The invention will now be described in greater detail by way of embodiments and with reference to the drawings.

DESCRIPTION OF EMBODIMENTS

Figure 1:
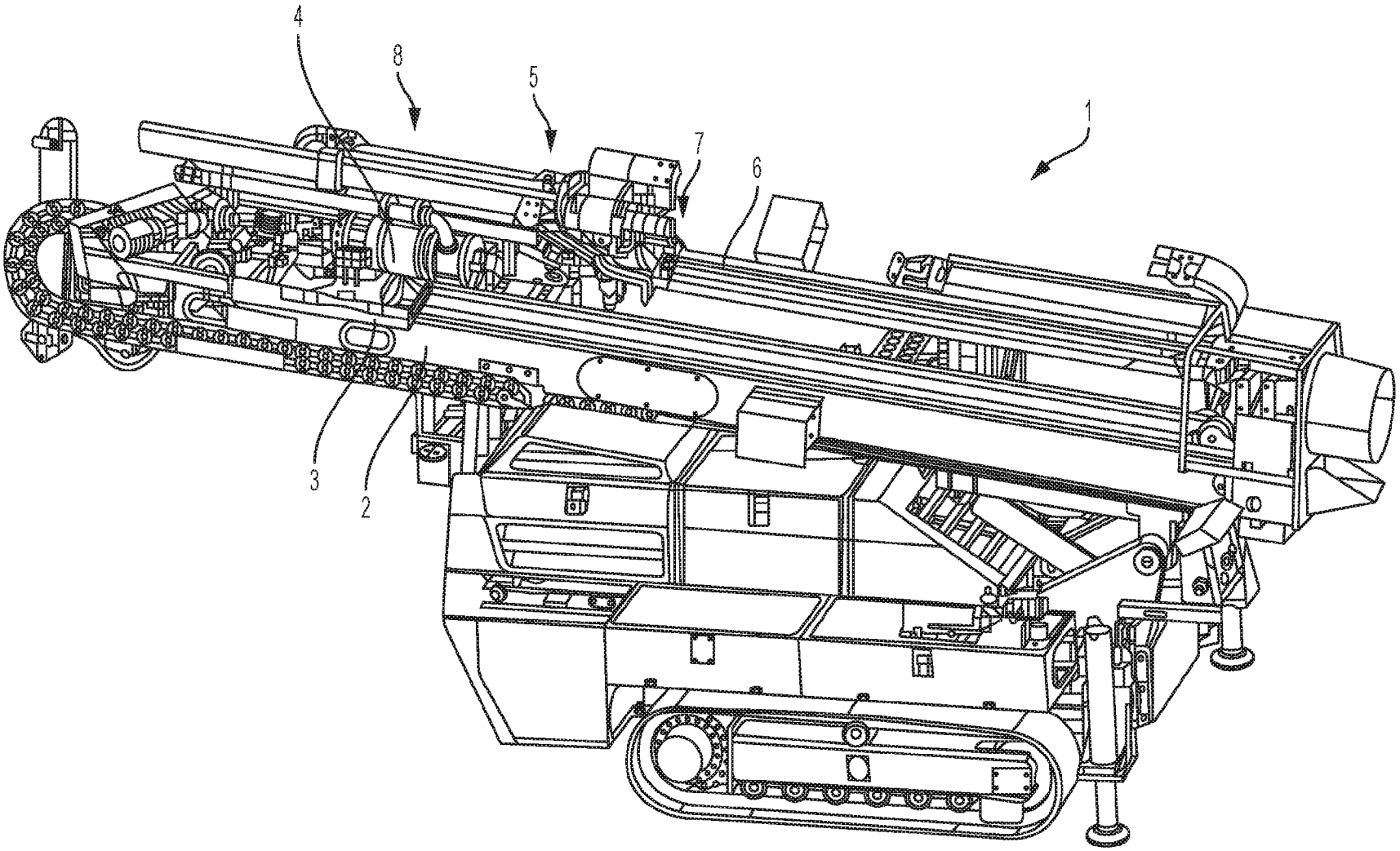
FIG. 1 shows a rock drill rig equipped with a feed beam for a rock drilling machine and a linear guide for a device for handling drill string components.

FIG. 1 shows diagrammatically a rock drill rig 1, which is equipped with a feed beam 2 whereon a (drilling machine) slide 3 supporting a rock drilling machine 4 is movable to and fro. On the feed beam 2 there is fastened a device 5 for handling drill string components including a linear guide 6 whereon a (handling) slide 7 with a gripping device 8 is movable to and fro.

The device for handling drill string components 5 is arranged to handle drill string components being stored in a magazine (not shown) for drill string components close to the rock drill rig and to successively position them in a drill string position of the rock drilling machine 4. The device for handling drill string components 5 is also arranged to successively remove drill string components from the drill string position and place them in said magazine when the drill string is taken out from a bore hole, for example when it is time to replace the drill bit.

Figure 2:
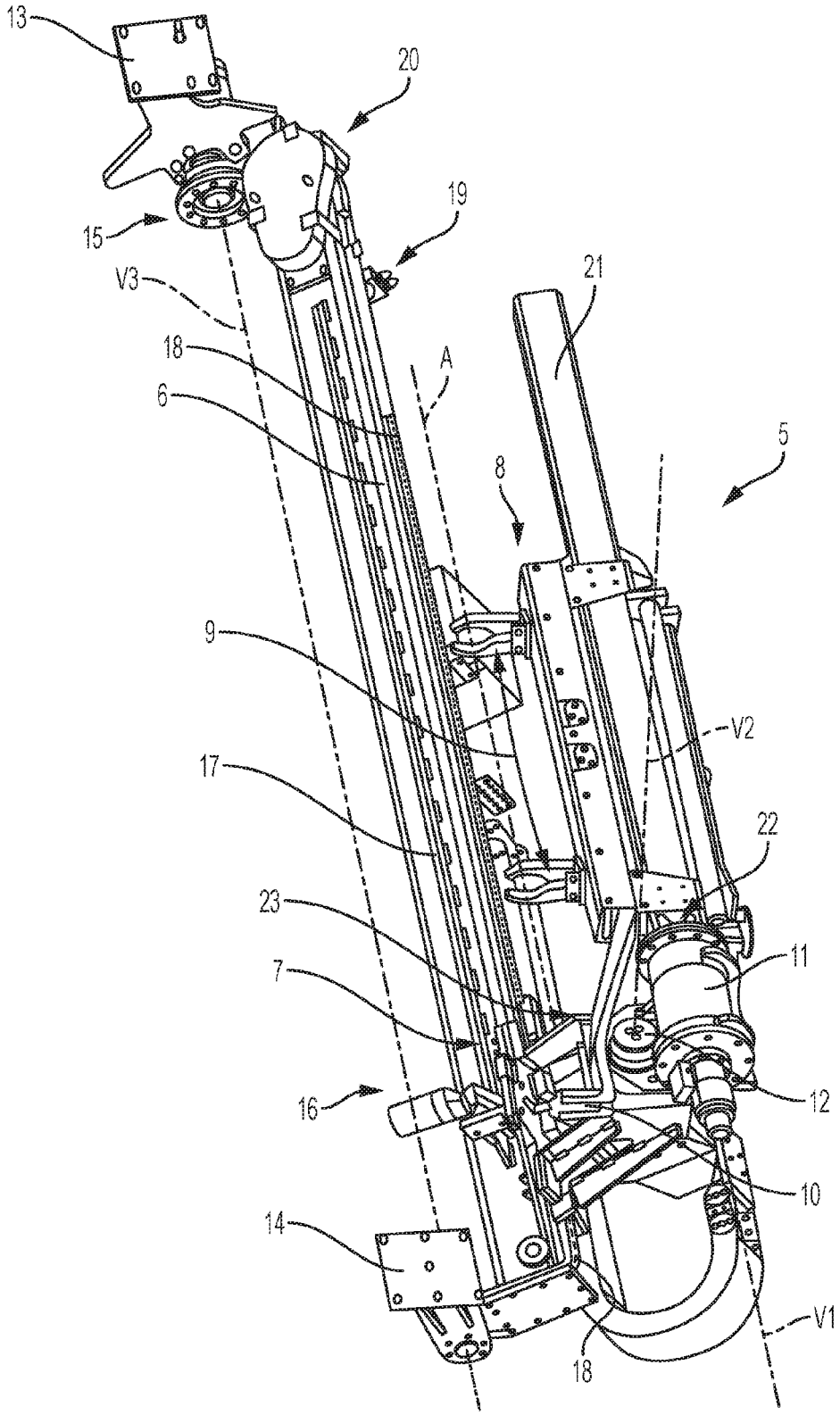
FIG. 2 shows the device for handling drill string components in FIG. 1 separated from the feed beam and in a greater scale.

In FIG. 2, the linear guide 6 is shown and the to and fro movable slide 7, whereon is attached the gripping device 8 which includes two axially separated gripper pairs 9 as seen in an axial direction of a gripped drill string component. The gripping device 8 is supported axially displaceable along a swing arm 21, also seen in an axial direction of a gripped drill string component. The swing arm 21 is connected to a swing arm fastener 22 and is in turn, with supported gripping device 8, and in respect to the slide 7, swing drivable with the aid of a first rotator 11 around a first rotational axis V1 being parallel to and at a distant from an axis A of a drill string component (not shown) being gripped by the gripping device.

Through this ability to be swing driven, the position of the gripping device can be fine adjusted laterally, e.g. prior to gripping a drill string component in order to overcome unintentional deviation from a desired delivering position.

The swing arm 21 with supported gripping device 8 is swing drivable by a second rotator 12, in respect of a support 23 and the slide 7, around a second rotational axis V2 forming an angle with the linear guide 6 as well as with the first rotational axis V1. This swingability results in that the swing arm 21 can be swung from a position where it is parallel to the linear guide 6 to positions for forming an angle between the swing arm 21 and the linear guide 6.

The swing arm support 22 and thereby the swing arm 21 with supported gripping device 8 is further, with the aid of a third rotator 15, swing drivable around a third rotational axis V3 being parallel to the linear guide 6, for swinging the gripping device into the drill string position.

In this case the third rotational axis V3 is positioned between the linear guide 6 and fastening points therefore on the feed beam 2, whereby the ability to be swing driven around the third rotational axis V3, being parallel to the linear guide 6, also includes swing driving the linear guide 6. The device 5 for handling drill string components is thus in this case fastened to the feed beam 2 over a first support 13 and a second support 14. The linear guide 6 with supported slide 7 (and components carried by the slide) is swingable in respect of the supports 13 and 14 and to the feed beam by a third rotator 15 around the third rotational axis V3.

The gripping device 8 also provides an axial stop 10 for a gripped drill string component.

In the shown embodiment, the first rotational axis V1 is perpendicular to the second rotational axis V2 which in turn is perpendicular to the third rotational axis V3. The second rotational axis V2, however, is positioned at a distance from and does not intersect either with the first rotational axis V1 or with the third rotational axis V3.

The slide 7 is further equipped with a safety brake 16 which co-operates with a brake beam 17 being arranged along the linear guide 6 and being provided with a brake surface on each side. The safety brake 16 is in the shown example a normally locked clamping brake which in unloaded condition clamps on the brake beam 17 such that the slide 7 with associated gripping device 8 is locked in respect of the linear guide for preventing that the slide with the gripping device, possibly with gripped, heavy drill string component, falls to a lowermost position, whereby serious risks for injury on the operator and possible other persons in the vicinity could occur.

The slide 7 also has other means for co-operation with a drive chain, which is indicated with interrupted lines at 18.

This drive chain is driven by a driver device 19, partly being shown in FIG. 2, for a movement to and fro of the slide 7 along the linear guide 6. The drive chain is positioned in a loop so that it co-operates with the driver device 19 over a drive transmission 20 and a not shown freely rotatable chain wheel positioned at the lower part of the linear guide 6, as it is shown in FIG. 2.

Figure 3:
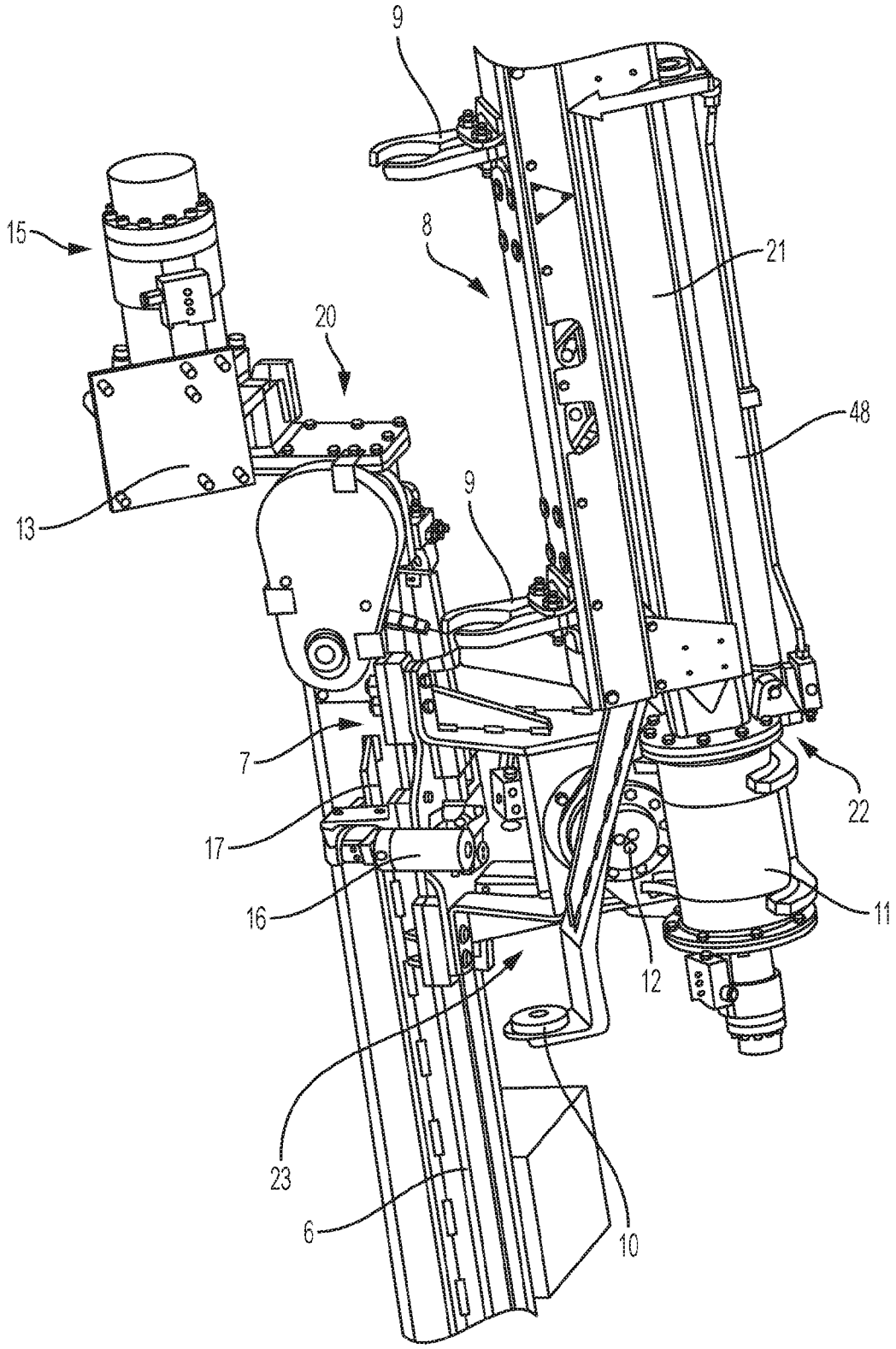
FIG. 3 shows an enlarged view of a detail of the device for handling drill string components in a greater scale.

FIG. 3 shows the arrangement of the slide 7 in greater scale, and in a somewhat altered perspective for clarifying purposes. The slide has here been brought to an upper position close to the first support 13. A hydraulic cylinder 48 is arranged along the swing arm 21 for driving the gripping device 8 to and fro.

Figure 4:
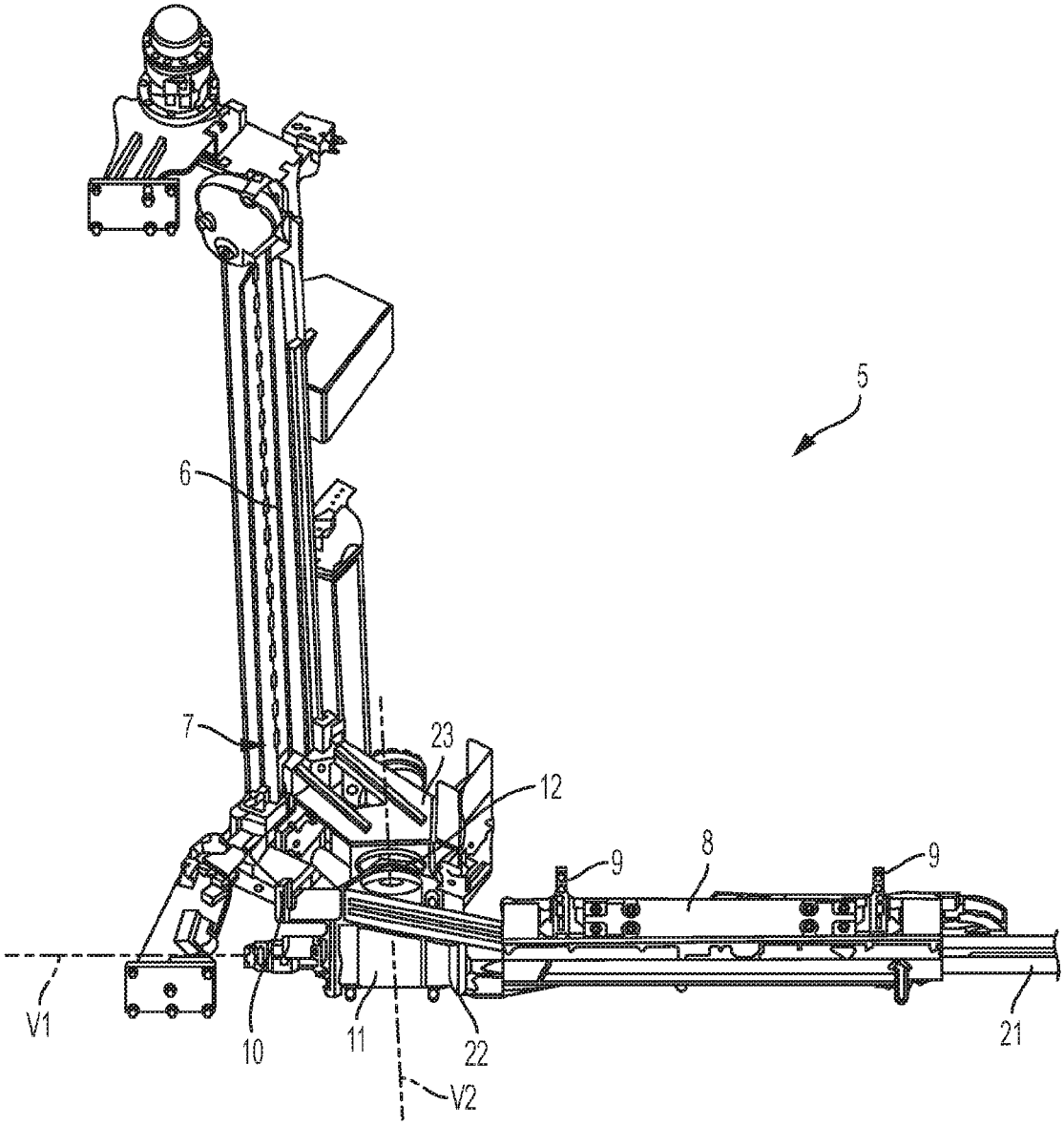
FIG. 4 shows the device of FIG. 2 in another position.

FIG. 4 shows the device 5 with the swing arm 21 swung down around the axis V2 such that it together with the gripping device 8 is in a horizontal position, normally suited for gripping a drill string component. Since the slide 7 is displaceable up and down along the linear guide 6 and the gripping device is displaceable along the swing arm 21, the gripping device can be adjusted vertically as well as longitudinally in order to be adequately positioned to a drill string component to be gripped. Further, swingability around the axis V1 allows possibility of adjustment laterally in case this could be required.

Figure 5:
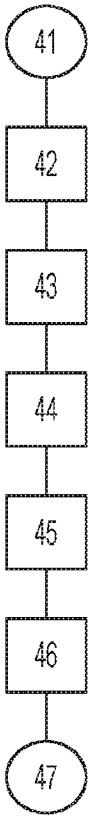
FIG. 5 shows diagrammatically a block diagram of a sequence of a method according to the invention, and FIGS. 6 *a, b, c* and *d* show diagrammatically the movements of the device during a method sequence.

FIG. 5 shows a block diagram of a sequence of a method for handling and in this case gripping and positioning of a drill string component to a drill string position according to the invention, wherein:

Position 41 indicates the start of the sequence.

Position 42 indicates that the gripping device with open gripper pairs is aligned to a drill string component in a delivering position in a magazine by rotating the swing arm and possibly axially displacing the gripping device thereon.

Position 43 indicates that the gripping device is brought down to a grip position of the gripper pairs by swinging the swing arm and/or displacing it downwards of the slide with supported gripping device. See FIG. 6*a*.

Position 44 indicates that the gripper pairs of the gripping device is brought to grip the drill string component.

Figure 6D:
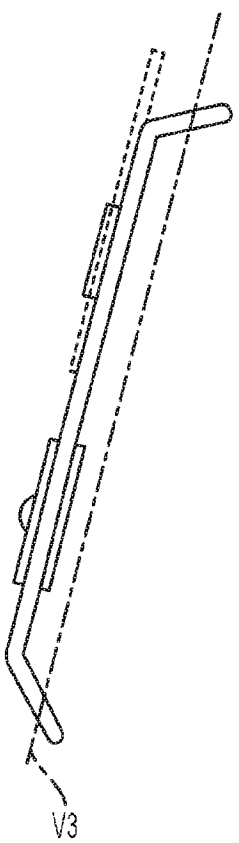
Figure 6C:
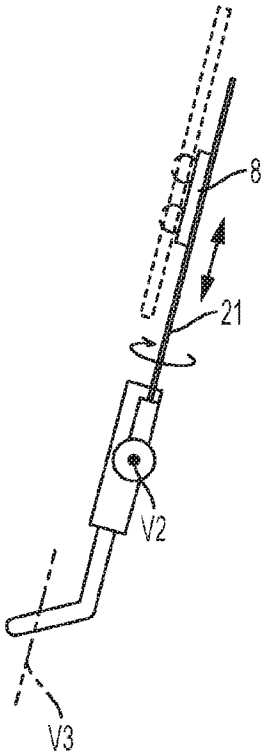
Figure 6B:
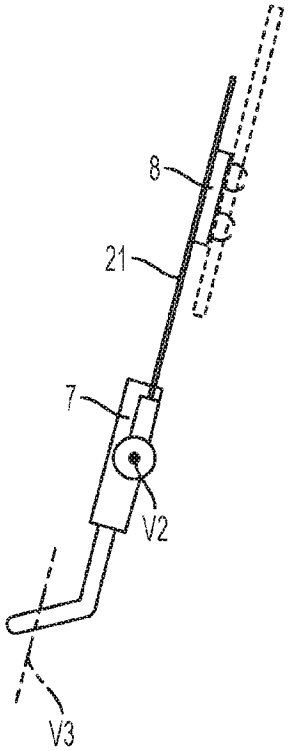

Position 45 indicates that the slide with the gripped gripping device is displaced upwardly, the swing arm is swung upwardly to a position where it is essentially parallel to the linear guide. See FIG. 6*b*. The swing arm is now swung such that the gripping device is redirected about 180°. See FIG. 6*c*.

Position 46 indicates that the third rotator is activated for swinging of the drill string component to the drill string position. See FIG. 6*d*.

Position 47 indicates threading together of the drill string component with a component belonging to the drill string by activating the rotator of the rock drill rig, opening the gripper pairs, removing the gripping device from the drill string component and thereupon ending the sequence.

The different swing movements can in certain cases occur overlapping and in reverse order which is obvious to the person skilled in the art. In certain cases the drill string component needs to be axially displaced and be re-gripped within the scope of the sequence step of position 44 in order to ensure that the end of the drill string component abuts an end stop being associating with the gripping device.

The invention can be varied within the scope of the following claims. The rotators can be arranged differently and with other mutual angles than what is shown on the Figures.

It is possible to supplement the device according to the invention with an automatic control for positioning, gripping and transferring drill string components between a drill string position in a rig and a magazine.

Figure 6A:
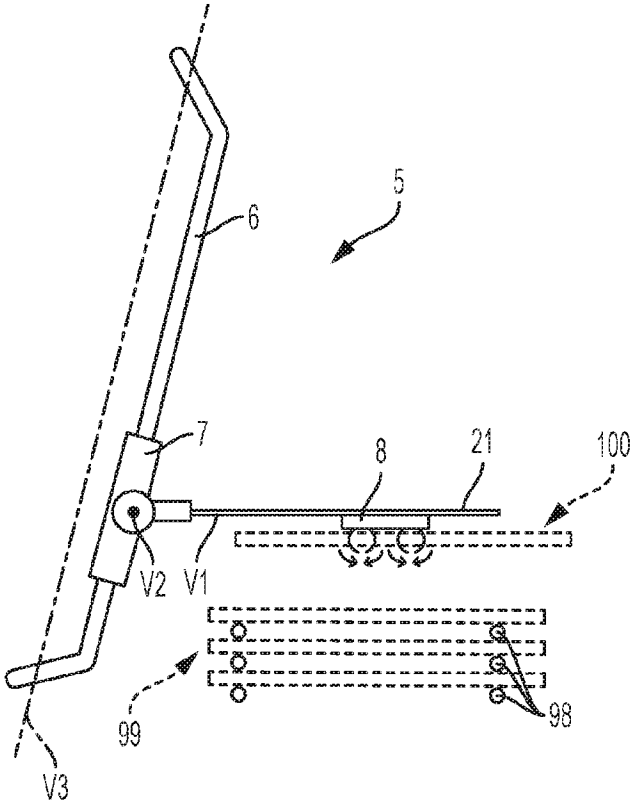

With reference to FIG. 6*a*, the handling device 5 suitably includes a magazine 99 having support members 98 for drill string components 100. The magazine is suitably displaceably connected to the rock drill rig in order to facilitate positioning in different angular positions of the feed beam. In particular, the magazine is suitably displaceable in directions parallel to axial directions of drill string components being received in the magazine. Further, it is preferred that the magazine includes support members 98 in the form of component brackets in a plurality of levels and that the component brackets on one level are removable for access to drill string components on a lower level, wherein suitably said support members are arranged for receiving a plurality of drill string components on the same level, wherein said support members are adjustable for inclination towards the delivering position when it is a pick-up position of the gripping device and from the delivering position when it is a release position for the gripping device.

The invention claimed is:

1. A handling device for a rock drill rig for handling drill string components for a drill string being driveable by a rotator which is displaceable along a feed beam of the rock drill rig, wherein a gripping device for gripping a drill string component is displaceable between a drill string position in the rock drill rig and a delivering position outside the rock drill rig, the handling device comprising:

a linear guide to be arranged in connection with and in parallel with the feed beam, and a slide being displaceable along the linear guide, a swing arm configured to support the gripping device, wherein the swing arm is supported by the slide, a swing arm support connected to the slide, the swing arm support and a first rotator configured to swing drive the swing arm and supported gripping device around a first rotational axis being parallel to and at a distance from a longitudinal axis of the drill string component being gripped by the gripping device, a second rotator configured to swing drive with respect to the slide the swing arm support, swing arm and supported gripping device around a second rotation axis, the second rotation axis forming an angle with a longitudinal axis of the linear guide and forming an angle with the first rotational axis, and a third rotator configured to swing the gripping device to the drill string position, wherein the third rotator is further configured to swing drive the swing arm support, swing arm and supported gripping device around a third rotational axis parallel to the linear guide.

2. A handling device according to claim 1, wherein the linear guide is a separate unit fastenable to the feed beam.

3. A handling device according to claim 2, wherein the third rotational axis is positioned between the linear guide and fastening points therefore on the feed beam, whereby the swing drivability around the third rotational axis, being parallel to the linear guide, also includes swing driving the linear guide.

4. A handling device according to claim 1, wherein seen in a longitudinal direction of the gripped drill string component, the gripping device is supported axially and displaceably drivable along the swing arm.

5. A handling device according to claim 1, wherein a support for the second rotator is rigidly connected to the slide.

6. A handling device according to claim 1, further comprising:

the first rotator having a first exit axis, the first exit axis fixedly positioned with respect to the swing arm, and the second rotator having a second exit axis, the second exit axis fixed positioned with respect to a main portion of the first rotator.

7. A handling device according to claim 1, wherein the second rotational axis is essentially perpendicular to the linear guide and to the first rotational axis.

8. A handling device according to claim 1, wherein the linear guide includes linear drive means for the slide.

9. A handling device according to claim 1, further comprising:

a magazine having support members for drill string components.

10. A handling device according to claim 9, wherein the magazine is displaceably connectable to the rock drill rig.

11. A handling device according to claim 10, wherein the magazine is displaceable in directions parallel to axial directions of drill string components being received in the magazine.

12. A handling device according to claim 9, wherein the magazine includes a support comprising component brackets in a plurality of levels, and wherein the component brackets on one level are removable for access to drill string components on a lower level.

13. A handling device according to claim 12, wherein said support members are adapted for receiving a plurality of drill string components on the same level, wherein said support is adjustable for inclination towards the delivering position when the delivering position is a pick-up position for the gripping device and from the delivering position when the delivering position is a release position for the gripping device.

14. A handling device according to claim 1, wherein seen in a longitudinal direction of the gripped drill string component, the gripping device includes at least two axially separated gripper pairs.

15. A method for handling drill string components of a drill string of a rock drill rig, the drill string being driveable by a rotator which is displaceable along a feed beam of the rock drill rig, the method comprising:

displacing a slide along a linear guide to be arranged in parallel with the feed beam, gripping a drill string component with a gripping device being supported by the slide, and displacing the gripping device between a drill string position in the rock drill rig and a delivering position outside the rock drill rig, swinging a swing arm supporting the gripping device with respect to a swing arm support being connected to the slide around a first rotational axis, being parallel to and at a distance from a longitudinal axis of the drill string component being gripped by the gripping device, swinging the swing arm support, and thereby the swing arm with supported gripping device with respect to the slide around a second rotation axis, the second rotation axis forming an angle with a longitudinal axis of the linear guide and forming an angle with the first rotational axis, and swinging the swing arm support, and thereby the swing arm with supported gripping device around a third rotational axis parallel to the linear guide, for swinging the gripping device to the drill string position.

16. The method according to claim 15, wherein swing driving around the third rotational axis, being parallel to the linear guide, also includes swing driving the linear guide.

17. The method according to claim 15, wherein seen in a longitudinal direction of a gripped drill string component, the gripping device is axially displaced along the swing arm.

18. The method according to claim 15, wherein the second rotational axis is essentially perpendicular to the linear guide and to the first rotational axis.

19. The method according to claim 15, further comprising:

displacing a magazine connected to the rock drill rig with respect to the rock drill rig.

20. The method according to claim 19, further comprising:

displacing the magazine in directions parallel to longitudinal directions of drill string components being received in the magazine.

21. The method according to claim 20, further comprising:

arranging at a plurality of levels in the magazine a support comprising component brackets, wherein the component brackets on one level are removed for access to drill string components on a lower level.

22. The method according to claim 21, wherein said magazine has support members, said support members are adapted for receiving a plurality of drill string components on the same level, wherein said support is adjusted for inclination towards the delivering position when the delivering position is a pick-up position for the gripping device and from the delivering position when the delivering position is a release position for the gripping device.

23. A rock drill rig, comprising:

a rotator being displaceable along a feed beam, and a handling device comprising a linear guide to be arranged in connection with and in parallel with the feed beam, and a slide being displaceable along the linear guide, a swing arm configured to support a gripping device, wherein the swing arm is supported by the slide, a swing arm support connected to the slide, the swing arm support and a first rotator configured to swing drive the swing arm and supported gripping device around a first rotational axis being parallel to and at a distance from a longitudinal axis of a drill string component being gripped by the gripping device, a second rotator configured to swing drive with respect to the slide the swing arm support, swing arm and supported gripping device around a second rotation axis, the second rotation axis forming an angle with a longitudinal axis of the linear guide and forming an angle with the first rotational axis, and a third rotator configured to swing the gripping device to a drill string position, wherein the third rotator is further configured to swing drive the swing arm support, swing arm and supported gripping device around a third rotational axis parallel to the linear guide.

* * * * *